US008031885B2

(12) United States Patent
Raisanen

(10) Patent No.: US 8,031,885 B2
(45) Date of Patent: Oct. 4, 2011

(54) PREAMPLIFIER ARRANGEMENT FOR A DRUM MICROPHONE

(75) Inventor: Heikki Raisanen, Muurame (FI)

(73) Assignee: B-Band Oy, Vaajakoski (FI)

( * ) Notice: Subject to any disclaimer, the term of this patent is extended or adjusted under 35 U.S.C. 154(b) by 1319 days.

(21) Appl. No.: 11/639,359

(22) Filed: Dec. 14, 2006

(65) Prior Publication Data

US 2007/0160235 A1 Jul. 12, 2007

(30) Foreign Application Priority Data

Dec. 19, 2005 (FI) ..... 20050426 U

(51) Int. Cl.
*H04R 25/00* (2006.01)

(52) U.S. Cl. ..... 381/118; 381/361; 381/355; 381/120

(58) Field of Classification Search ..... 381/118
See application file for complete search history.

(56) References Cited

U.S. PATENT DOCUMENTS

| | | | | |
|---|---|---|---|---|
| 3,665,490 A | | 5/1972 | Oskar | |
| 4,201,107 A | * | 5/1980 | Barber et al. | 84/743 |
| 4,227,049 A | * | 10/1980 | Thomson et al. | 381/93 |
| 4,570,522 A | * | 2/1986 | May | 84/723 |
| 6,121,528 A | | 9/2000 | May | |
| 7,297,863 B2 | * | 11/2007 | May | 84/723 |

FOREIGN PATENT DOCUMENTS

| | | |
|---|---|---|
| DE | 3917912 | 12/1990 |
| DE | 4007440 | 5/1991 |
| DE | 4017554 | 12/1991 |
| DE | 41 22 316 | 1/1993 |
| GB | 2305767 | 4/1997 |
| JP | 4121000 | 10/1992 |

* cited by examiner

*Primary Examiner* — Davetta Goins

*Assistant Examiner* — Jasmine Pritchard

(74) *Attorney, Agent, or Firm* — Katten Muchin Rosenman LLP

(57) ABSTRACT

A preamplifier arrangement for a drum microphone, in which drum the microphone is arranged inside the drum and wherein the microphone is connected to a preamplifier, characterized in that the preamplifier is secured to the side wall or bottom of the resonance chamber of the drum via a mounting arrangement comprising a threaded part, which is fastened to the preamplifier and fitted through a hole in the side wall or bottom, and a counterpart for it.

13 Claims, 1 Drawing Sheet

PREAMPLIFIER ARRANGEMENT FOR A DRUM MICROPHONE

The present invention relates to a preamplifier arrangement for drum microphones. In particular, the invention relates to a solution for connecting a microphone arranged inside a drum to a preamplifier.

BACKGROUND OF THE INVENTION

Traditionally, the microphones used with drums have been ordinary microphones, which have been mounted beside the drums by means of a special holder designed for this purpose. A drawback with these arrangements is especially the fact that such a microphone is very sensitive to receive other sounds, too, from around the drums. In addition, they are difficult to install, and the microphone impedes the drumming and is susceptible to damage.

Drum microphones placed inside drums are also known. A drum microphone of this type Is disclosed in specification DE 4122316, which describes a microphone designed to be fitted inside a drum and secured inside the drums by means of a mounting part fitted in a hole provided on the side of the resonance chamber of the drums. The microphone connection cable leading to the amplifier is then plugged into a connector in the mounting part.

Also known in prior art are strip-like electret microphones, e.g. B-Band's DST transducer, which is a so-called electret bubble film transducer, mounted inside a drum e.g. below the membrane, at the upper edge of the resonance chamber. Microphones fitted inside drums effectively prevent extraneous noise from getting mixed with the drum sound to be passed to the amplifier.

In drum microphones, the sound is then passed to a separate amplifier placed outside the drum and comprising a preamplifier, which adapts the drum signal for other amplifier stages e.g. for loudspeakers or recording. A drawback with existing amplifier arrangements is their complicated structure and especially the fact that the preamplifier is mounted separately from the drum.

BRIEF DESCRIPTION OF THE INVENTION

The object of the present invention is to overcome the drawbacks of prior-art solutions and to solve the problems by using a new type of preamplifier arrangement, wherein the preamplifier Is secured to a hole provided in the side of the resonance chamber of a drum. A side wall of the resonance chamber is typically pre-provided with a few holes, permitting air to flow out of the resonance chamber, The present Invention makes use of these holes so that the preamplifier can be secured to such a hole by means of a screw-like mounting part with an open interior cavity, thus simultaneously ensuring that air can flow out from the resonance chamber through this mounting part.

In a preferred embodiment of the invention, the transducer membrane used is an electret bubble film microphone, the connection cable of which is passed through the mounting arrangement of the invention.

The features of the preamplifier arrangement of the invention for a drum microphone are presented in detail In the claims below.

The invention makes it possible to produce a very simple drum microphone preamplifier structure fitted to a drum, allowing the preamplifier to be easily integrated in the drum.

BRIEF DESCRIPTION OF THE FIGURES

In the following, the invention will be described in detail by referring to an example and the attached drawings, wherein

FIGS. 1 and 2 present a drum having a cylindrical resonance chamber 1 and a drum membrane 3 fitted to it by means of fastening parts 2. The side wall of the resonance chamber is provided with holes 4 permitting the flow of air through them.

Figure 1:
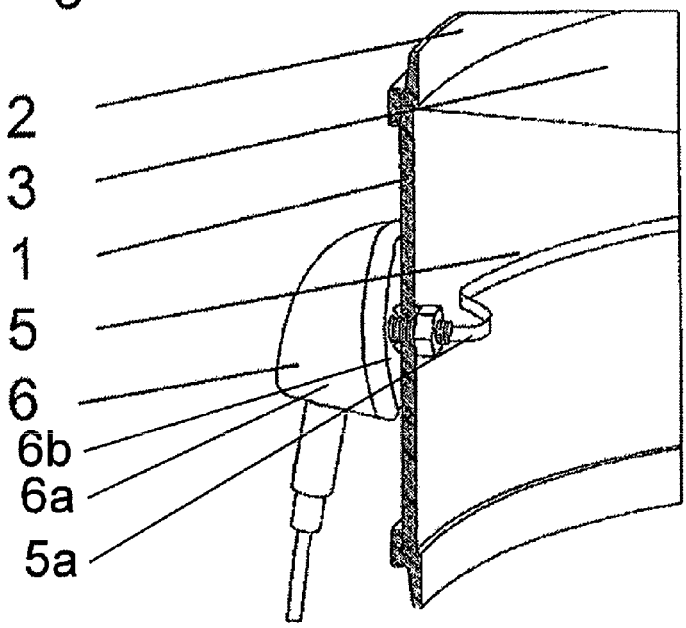
FIG. 1 presents the drum preamplifier arrangement of the invention in an installed state.
Figure 2:
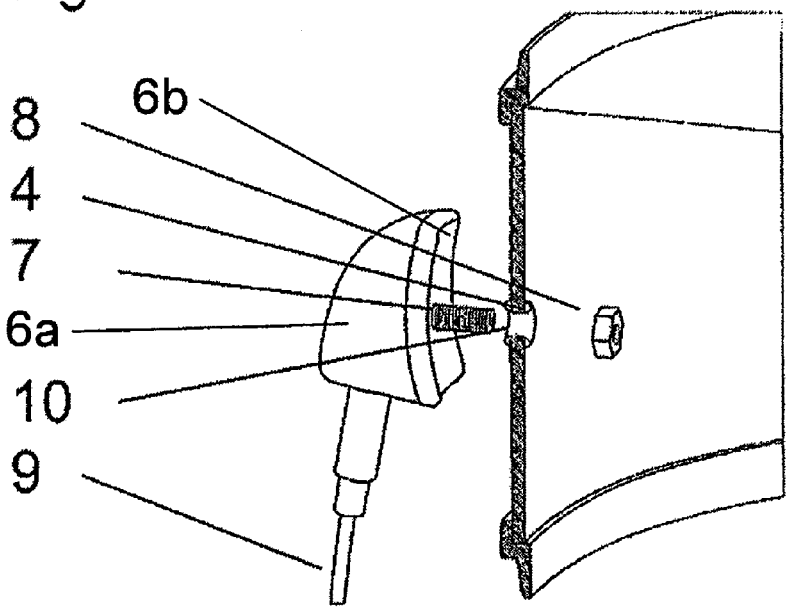
FIG. 2 presents an exploded view of the drum preamplifier arrangement of the invention.

Fitted inside the drum is an electret bubble film microphone 5, which is connected to a preamplifier 6 by a connection cable 5*a*. The preamplifier 6 having a housing 6*a* is secured to the side of the resonance chamber by means of a mounting part, which comprises a screw part 7 having an open interior cavity and provided with an external thread, the screw part being pushed through a hole 4, and, as a counterpart for the screw, a nut 8 fitted inside the resonance chamber, by means of which parts the preamplifier can be secured to the side wall of the resonance chamber. The connection cable from the microphone to the preamplifier is passed through the screw part 7. From the preamplifier, the sound of the drums is passed to other amplifier stages via an amplifier connection cable 9. The hole 4 may be provided with a small bush 10, through which the screw is passed. The housing comprises a non-flat base 6*b* that is disposed directly against a portion of the drum in the assembled state as illustrated in FIG. 1.

It is obvious to a person skilled in the art that different embodiments of the invention are not exclusively limited to the examples described above, but that they may be varied within the scope of the claims presented below. The invention can also be applied for use with other than electret bubble film microphones.

The invention claimed is:

1. An assembly for a preamplifier for a drum microphone, the drum microphone being disposed inside a resonance chamber of a drum, the assembly comprising:

a housing;

a connection cable placing the drum microphone in operative connection with the preamplifier;

a mounting arrangement for securing the housing to a sidewall or a bottom of the drum, the mounting arrangement comprising a hollow support arm and a counterpart, the support arm comprising a first end and a second end, the first end secured to the housing, the second end disposed through an opening in the sidewall or the bottom of the drum and extending into the resonance chamber, the counterpart securing the support arm to the sidewall or the bottom of the drum, wherein the connection cable is disposed in an interior of the support as it passes through the sidewall or the bottom of the drum.

2. The assembly of claim 1, wherein the counterpart is a nut and the support arm comprises a threaded portion.

3. The assembly of claim 1, further comprising a bushing, the bushing being disposed around the opening.

4. The assembly of claim 1, further comprising an amplifier connection cable.

5. The assembly of claim 1, wherein the housing comprises a non-flat base, the non-flat base being disposed directly against a portion of the drum.

6. The assembly of claim 5, wherein air flows through the interior of the support arm into the resonance chamber.

7. A preamplifier arrangement for a drum, the arrangement comprising:

a microphone disposed inside a resonance chamber of the drum;

a preamplifier comprising a housing;

a connection cable placing the drum microphone in operative connection with the preamplifier;

a mounting arrangement for securing the housing to a sidewall or a bottom of the drum, the mounting arrangement comprising a hollow support arm and a counterpart, the support arm comprising a first end and a second end, the first end secured to the housing, the second end disposed through an opening in the sidewall or the bottom of the drum and extending into the resonance chamber, the counterpart securing the support arm to the sidewall or the bottom of the drum, wherein the connection cable is disposed in an interior of the support arm as it passes through the sidewall or the bottom of the drum.

8. The arrangement of claim 7, wherein the microphone is a strip-like electret microphone.

9. The arrangement of claim 7, wherein the counterpart is a nut and the support arm comprises a thread.

10. The arrangement of claim 7, further comprising a bushing, the bushing being disposed around the opening.

11. The arrangement of claim 7, further comprising an amplifier connection cable.

12. The arrangement of claim 7, wherein the housing comprises a non-flat base, the non-flat base being disposed directly against a portion of the drum.

13. The arrangement of claim 7, wherein air flows through the interior of the support arm into the resonance chamber.

* * * * *